United States Patent [19]

Haskell

[11] Patent Number: 4,722,305

[45] Date of Patent: Feb. 2, 1988

[54] APPARATUS AND METHOD FOR OXIDATION AND CORROSION PREVENTION IN A VEHICULAR COOLANT SYSTEM

[75] Inventor: Weston W. Haskell, Houston, Tex.

[73] Assignee: Shell Oil Company, Houston, Tex.

[21] Appl. No.: 31,634

[22] Filed: Mar. 30, 1987

[51] Int. Cl.[4] ..... F01P 11/02

[52] U.S. Cl. ..... 123/41.27; 165/104.32; 55/74; 55/385 B

[58] Field of Search ..... 123/41.27; 165/104.32; 55/74, 316, 385 B, 387

[56] References Cited

U.S. PATENT DOCUMENTS

| | | | |
|---|---|---|---|
| 3,820,593 | 6/1974 | Pabst | 165/104.32 |
| 4,199,332 | 4/1980 | Krohn et al. | 165/104.32 |
| 4,289,505 | 6/1980 | Hardison et al. | 55/59 |
| 4,381,929 | 4/1981 | Mizuno et al. | 55/316 |
| 4,387,671 | 6/1983 | Jarvis | 55/385 B |
| 4,576,929 | 12/1984 | Shimazaki | 502/417 |
| 4,592,418 | 6/1986 | Cadars | 165/104.32 |
| 4,686,942 | 8/1987 | Hayashi et al. | 123/41.27 |

*Primary Examiner*—William A. Cuchlinski, Jr.
*Attorney, Agent, or Firm*—Kimbley L. Muller

[57] ABSTRACT

This invention concerns a coolant system for a vehicle which possesses a radiator and an excess coolant reservoir to reduce the content of oxygen in the radiator cooling system. An exhaust vent tube communicates with ambient air and the excess coolant reservoir to expel gases generated during engine startup and continuous use. A vacuum exhaust valve is situated in the exhaust vent tube to provide for the expulsion of gas and acts, during engine cool down, to pass exhaust gas to the excess coolant reservoir. This invention situates an adsorption zone, preferably comprised of activated carbon, intermediate the exhaust vent tube and the excess coolant reservoir to adsorb a large quantity of the oxygen being passed to the excess coolant reservoir during cool down periods. Once spent of its adsorption qualities, the adsorbent in the adsorption zone is regenerated by contact with automotive engine exhaust gas at a temperature of between 140° C. and 150° C.

13 Claims, 1 Drawing Figure

APPARATUS AND METHOD FOR OXIDATION AND CORROSION PREVENTION IN A VEHICULAR COOLANT SYSTEM

FIELD OF THE INVENTION

The field of this invention concerns the elimination of oxidation and corrosion in a cooling system of a vehicle having an internal combustion engine. Normally, such cooling systems operate in the presence of specific antifreeze coolants having complex additive systems to reduce oxidation and corrosion. The field of this invention concerns an apparatus and method which will eliminate or at least mitigate the need for these expensive corrosion inhibitive additives and will provide a simplified cooling system. This apparatus and method will also extend the life of corrosion inhibitor additive in operating cooling systems.

The field of this invention also concerns a regeneratable system to excise oxygen from ambient air using the facilities indigenous to an internal combustion engine. The field of this invention also concerns an additive-free means to operate a cooling system without problems of corrosion or oxidation.

BACKGROUND OF THE INVENTION

There are a plethora of references which describe the use of activated carbon or the like for the removal of a gas from a liquid. Some of the classifications pertinent to this invention concern Class 55, Subclasses 74, 75, 98, 387 and 522; Class 502, Subclasses 416 and 421; Class 165, Subclass 148; and Class 210, Subclasses 502.1 and 750. Exemplary of prior art which show the use of activated carbon for the removal of a gas from a fluid using activated carbon or the like are Hardison et al, U.S. Pat. No. 4,289,505; Shimazaki, U.S. Pat. No. 4,576,929; and Mizuno et al, U.S. Pat. No. 4,381,929. In the latter patent, activated charcoal is utilized to absorb fuel vapor from a fuel tank. A three dimensional network cell activated carbon cannister, which is lightweight in structure, is more active than the conventional pellet-formed activated charcoal for adsorption of vapor of an automotive fuel. Another modification of granular activated carbon for the purpose of water purification is described in aformentioned Shimazaki. In this reference, specific carbon fibers derived from acrylic fibers and having certain physical characteristics are utilized to extract both high and low molecular weight contaminants from water. In aforementioned Hardison, the regeneration qualities of an activated carbon absorption are described utilizing steam as one activating agent. Again, the above patents are exemplary of different means to remove a gas or vapor from a fluid using activating carbon.

OBJECTS AND EMBODIMENTS

It is an object of this invention to provide a radiator core cooling system useful in contemporary automobiles which will be free from oxidation and corrosion without the necessity of adding expensive chemical additives and antifreeze to chemically vitiate the effects of entrained oxygen added to a radiator core.

It is another object of this invention to provide a relatively simple apparatus for the capture of oxygen in a gas added to an overflow cooling system during the cooldown operation of an internal combustion engine.

It is another object of this invention to provide such an apparatus as above described which is regeneratable for further use on an interim basis said regeneration utilizing only the existing parts of an internal combustion engine.

It is a further object of this invention to provide a simplified method for constraining the amount of oxygen that is added to a radiator core cooling system during cooldown of the coolant fluid.

One embodiment of this invention resides in an apparatus to reduce the content of oxygen in a radiator cooling system which comprises: a radiator vessel containing a coolant for indirect heat exchange with an internal combustion engine wherein said radiator and said engine are interconnected through fluid connection means for passage of said coolant to indirect heat exchange with said engine; an excess coolant reservoir containing excess coolant to be used in said radiator vessel as heat exchange coolant, said excess coolant reservoir communicating with said radiator by means of a radiator coolant overflow connection means wherein said excess coolant from said reservoir flows into and from said radiator; an exhaust vent tube communicating with ambient air through a vacuum exhaust valve and said coolant reservoir to expel gas generated during start up or operation of said engine and transmitted to said reservoir; an adsorption zone situated in said exhaust vent tube intermediate said vacuum exhaust valve and said reservoir containing an adsorbent for the selective adsorption of oxygen from ambient air; and a vacuum exhaust valve situated in said exhaust vent tube to provide an orifice in said tube for the expulsion of gas and to provide a closed tube during engine cool down, wherein during engine cool down gases passed into the coolant reservoir, after passage over said adsorbent, contain a reduced quantity of entrained oxygen by means of the selected adsorption of the adsorbent.

Another embodiment of this invention resides in an apparatus for select substantial exclusion of oxygen from a cooling fluid of an internal combustion engine which comprises: an indirect cooling fluid radiator closed to ambient air and communicating with said internal combustion engine to indirectly cool said engine when in use; a radiator cap to provide closure of said radiator to said ambient air equipped with an overflow withdrawal means; an overflow cooling fluid vessel to maintain a supply of excess cooling fluid in addition to the cooling fluid of said radiator communicating with said radiator by means of connection through said radiator cap and by a fluid connection means interconnecting said radiator cap and said fluid vessel; an exhaust means for expulsion of gases from said overflow cooling fluid vessel generated during startup or continuous operation of said internal combustion engine; an activated carbon adsorbent communicating with said fluid vessel and said exhaust tube to adsorb entrained oxygen from any gas passing from the exhaust means to the fluid vessel during cool down of said internal combustion engine; and an engine exhaust gas in contact with said carbon adsorbent when said adsorbent is not in service to adsorb entrained oxygen from gases passing to said excess cooling fluid vessel, and to thereby renovate and regenerate the oxygen adsorption qualities of said carbon by contact of said carbon with exhaust gas from said internal combustion engine at a temperature of at least 140° C. (284° F.).

Another embodiment of this invention resides in a method of operating an internal combustion engine where said engine communicates with a cooling fluid reservoir that operates segregated from ambient air which comprises: passing cooling fluid in indirect heat exchange with said internal combustion engine to continuously cool said engine during periods of operation; passing cooling fluid from said fluid reservoir to an excess cooling reservoir provided with means to vent heated vapors to the ambient air wherein said vapors are generated through expansion of cooling fluid during heat up of said cooling fluid during said indirect heat exchange; cooling said cooling fluid after termination of said heat exchange with said internal combustion engine to cause fluid to be passed into said excess cooling reservoir; and passing said fluid generated by cooling through a predetermined amount of activated carbon adsorbent for adsorption of entrained oxygen, to thereby reduce the content of entrained oxygen in said generated fluid passed to said excess cooling reservoir and thereby the content of entrained oxygen passed to said cooling fluid reservoir.

BRIEF DESCRIPTION OF THE INVENTION

This invention concerns an apparatus which prevents or mitigates the amount of oxygen derived from air or exhaust gas from entering a closed radiator coolant system in cool down of the coolant in an overflow reservoir.

This invention comprises a select predetermined adsorption zone positioned intermediate an exhaust manifold and a radiator coolant overflow tank to contact all gases, normally drawn into the excess coolant during cool down, to excise oxygen from these gases and prohibit entry of oxygen to a closed radiator system. In this manner, all of the cool down gases added to the overflow reservoir are substantially oxygen-free and contain nearly 100% nitrogen, which does not promote oxidation or corrosion in the closed cooling system (radiator core).

DETAILED DESCRIPTION OF THE INVENTION

Contemporary automotive cooling systems are currently protected from oxidation and corrosion by complex chemical additive systems contained within carefully manufactured, expensive antifreeze. This invention seeks to mitigate the need of such complex additive systems and will allow the addition of pure methanol or ethylene glycol antifreeze to a radiator system. Life of radiator core coolant systems is generally limited by oxidation and corrosion. By implementation of this cooling system the life of these engine coolants may be greatly extended. As the central cooling system corrodes through oxidation, the flow of coolant antifreeze through the system becomes less efficient causing higher engine temperatures, which consequently result in engine damage to sensitive engine parts, such as piston rings and exhaust valves.

Sophisticated radiator core cooling devices in contemporary automobiles usually comprise a main radiator vessel containing a coolant for indirect heat exchange with an internal combustion engine. These two entities communicate by means of a fluid coolant passageway connecting the flow both to and from the main radiator vessel and the internal combustion engine. The type of fluid normally utilized for passage between the radiator core and an internal combustion engine, for indirect heat exchange, is normally glycol or a combination of glycol with water and other chemical additives.

It has been discovered (by others) that an excess coolant reservoir is advantageous to increase the efficiency of the radiator core cooling system. The excess coolant reservoir contains heat exchange coolant fungible with the cooling fluid in the radiator core vessel. These fluids can communicate with one another through conduit means situated in the radiator cap of the radiator, or by other means, whereby coolant freely flows from the excess cooling reservoir to the radiator core vessel.

During startup and operation of the internal combustion engine the fluid coolant is heated which expels gas which must be vented to the ambient air. For this purpose, an exhaust valve means is provided which communicates with ambient air and the excess coolant reservoir. These exhaust means are exemplified by a vacuum exhaust valve of an electrical solenoid to provide for the controlled opening and closing of the exhaust vent tube. This acts to control the quantity of generated gas being expelled to the atmosphere. The exhaust valve means is situated in the exhaust vent tube where, during engine cool down, the tube is closed. Even with this closure during engine cool down, gases pass into the excess coolant reservoir and thereby transmit oxygen to the coolant. Gases containing oxygen can also be derived from engine exhaust gas in the exhaust manifold. Regardless of its derivation, oxygen becomes entrained in the coolant, which is then passed to the radiator core vessel thereby causing undesirable oxidation and corrosion deterioration.

This invention provides for the placement of a select adsorption zone in the exhaust vent tube intermediate the exhaust manifold and excess coolant reservoir to capture any oxygen present in this cool down gas. It is preferred that this adsorption zone be comprised of activated carbon, such as can be formed in a pellet form or cannister, and that the adsorbent be present in sufficient quantity to capture substantially all of the oxygen in the gas passing through the exhaust vent tube during maximum time of engine cool down. It is most preferred that the activated carbon be wetted in-situ to enhance oxygen adsorption. It is also feasible that other activated carbons may be utilized and may be pretreated in any other method such that the amount of oxygen adsorption from air is maximized. One specific type of wet activated carbon, which can be utilized in this system, is a Calgon® BPL (4×10 mesh). It is believed that this type of activated carbon can excise oxygen down to 10 parts per billion measured at ambient conditions. By this mechanism, the coolant in the overflow coolant tank is not saturated with oxygen and oxygen is thereby prevented from any entering the radiator core.

One variance of this invention from existing coolant systems will be that both the overflow coolant tank and all connecting tubes including radiator to engine hoses should be constructed of an oxygen-impermeable substance. This can be exemplified by an oxygen-impermeable plastic or metal. This apparatus acts to lengthen the life of the coolant and the radiator core by reducing oxygen influx.

Another embodiment of this invention resides in an apparatus and method of regenerating the activated carbon or other adsorbent as rapidly as is practical. It was found to be not economically feasible to simply replace the activated carbon once it has become spent via oxygen adsorption. Out of practicality, regeneration occurs using only the basic components of the internal combustion engine already existent for operation of the internal combustion engine. A purge gas is necessary to elevate the adsorbent to sufficient regeneration temperature, i.e., 140° C. (284° F.), in the absence of oxygen. Preferably the chosen purge gas is exhaust gas derived from operation of the internal combustion engine via the exhaust manifold. The location of the carbon cannister can be variable but should be located away from the exhaust gas headers as far as necessary to heat the adsorbent to 140° C. The distance should also be predetermined to be removed from the headers so that the temperature of the adsorbent does not exceed 150° C. (302° F.). During this relatively narrow range of regeneration temperature, the adsorbent is regenerated to its near virgin state without reducing its vitality and integrity. A thermostatic valve can be present in the exhaust gas conduit to limit the temperature at which the exhaust gas contacts the adsorbent. For example, after a temperature of 145° C. is reached in the adsorption zone, the exhaust valve will close thereby preventing overheating and destruction of the adsorbent.

Exhaust gas remains in the engine manifold at engine shutdown. The exhaust tube connecting the manifold and the adsorpion zone should be situated to avoid intake of uncombusted air into the activated carbon adsorbent. This select situs of the exhaust tube reduces the oxygen ingress per se. The exhaust gas is comprised of water which acts to rehydrate the carbon bed, which is important in maintaining oxygen adsorption capacity of the adsorbent.

DETAILED DESCRIPTION OF THE DRAWING

Figure 1:
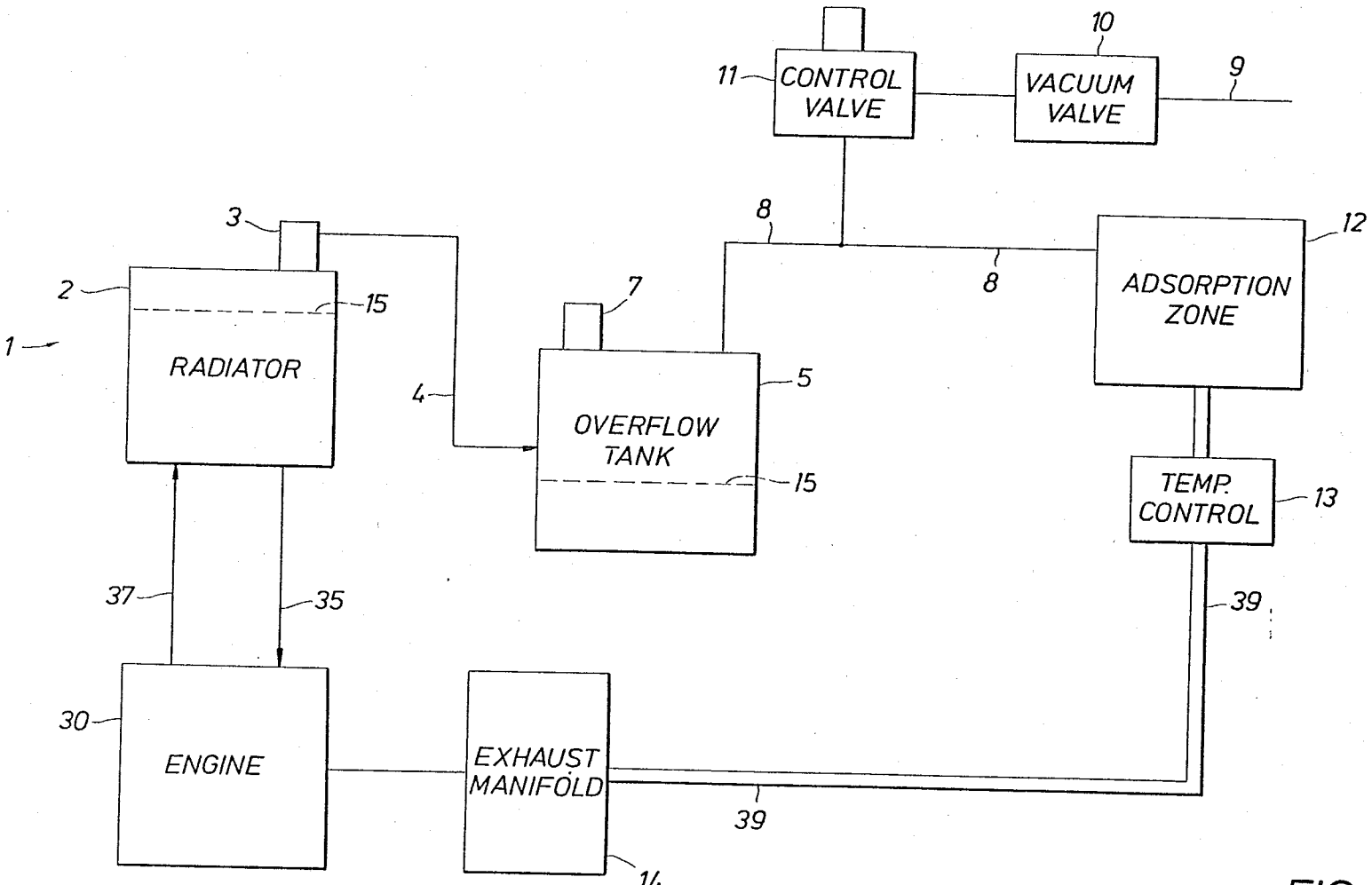
FIG. 1 is a schematic drawing of the apparatus of this invention showing how to use the instant method of reducing oxygen content in a radiator core cooling system.

Referring to FIG. 1, a radiator core 1 communicates indirectly to pass coolant 15 to engine block 30 by means of fluid communication means 35. Coolant is returned to radiator 1, from engine block 30, after its indirect heat exchange with the engine by means of fluid communication means 37. Radiator 1 comprises radiator tank 2, coolant 15 and radiator cap 3. The radiator core is conventionally operated in the absence of ambient air and at standard operating conditions. The coolant 15 is comprised of a cooling fluid such as water, methonol, glycol or other antifreeze with or without chemical additives. An overflow tank 5 is provided for excess coolant 15 which is transmitted to and from the radiator core by overflow tube 4, shown in FIG. 1 as connecting through radiator cap 3. An overflow vent cap 7 covers the overflow tank 5 from ambient air.

In order to expel gases generated during heatup and operation of internal combustion engine 30, a vent tube 8 is provided. A vacuum system comprising a vacuum connection 9, preferably connected an intake manifold of engine 30, and a vacuum valve controller 10 function concomitant with vent control valve 11 to eliminate any expelled gases. The vacuum controller 10 may also be an electrical solenoid to open the valve when engine 30 is running and to close the valve at engine shutdown. The novel situs of the instant adsorption zone of this invention is shown at 12 and contains a material effective to selectively absorb substantially all of the oxygen from exhaust gas or ambient air passing therethrough from exhaust manifold 14 via line 39, and conduit 8 to the excess coolant overflow tank 5. Exhaust manifold 14, either contained within engine block 30, or in an exhaust manifold associated therewith, acts to pass exhaust gas through conduit 39 and thermostatic control valve 13 to pass exhaust gas (to regenerate the activated adsorbent, preferably carbon or charcoal), over the adsorbent at a temperature of between 140° C. and 150° C. It is conceivable that higher temperatures can be utilized to regenerate the activated carbon although the same is not preferred due to carbon integrity.

When the engine 30 is operating or warming up, gases in radiator 2 expand so that gases are expelled from the radiator through overflow tube 4 to overflow tank 5. This creates a standing pool of coolant in the overflow tank. This, in turn, expels gas to the atmosphere by means of vent tube 8 past control valve 11. At this same time, the vacuum control valve 11 is held open by the vacuum valve or solenoid shown as 10. Hot exhaust gas flows from the exhaust manifold 14 into the activated carbon cannister 12 and out via vent tube 8 and vent valve 11. During cool down of the engine, vacuum valve (or solenoid) 11 is closed so that all gases drawn into the overflow tank 5 are treated by the activated carbon which in turn withdraws oxygen from these gases.

What I claim as my invention is:

1. An apparatus to reduce the content of oxygen in a radiator cooling system which comprises:

(a) a radiator vessel containing a coolant for indirect heat exchange with an internal combustion engine wherein said radiator and said engine are interconnected through fluid connection means for passage of said coolant to and from indirect heat exchange with said engine;

(b) an excess coolant reservoir containing excess coolant to be used in said radiator vessel as heat exchange coolant, said excess coolant reservoir communicating with said radiator by means of a radiator coolant overflow connection means wherein said excess coolant from said reservoir flows into and from said radiator;

(c) an exhaust vent tube communicating with ambient air through a valve means hereinafter situated as defined in step (e) and said excess coolant reservoir to expel gas generated during start up or operation of said engine and transmitted to said reservoir;

(d) an adsorption zone situated in said exhaust vent tube intermediate said valve means and said reservoir containing an adsorbent for the select adsorption of oxygen; and (e) a valve means situated in said exhaust vent tube to provide an orifice in said tube for expulsion of gas and to provide a closed tube during engine cool down, wherein during engine cool down, gases passed into the coolant reservoir after passage over said adsorbent have a reduced content of oxygen.

2. The apparatus of claim 1 wherein said adsorption zone communicates with a regenerating fluid means to elevate the temperature of said adsorbent in said adsorption zone to a temperature of at least 140° C. (284° F.) in the absence of oxygen to thereby regenerate said adsorbent.

3. The apparatus of claim 2 wherein said regenerating fluid comprises exhaust gas from said internal combustion engine and wherein said adsorption zone communicates with a temperature control means to cease passage of said exhaust gas when the temperature in said adsorption zone is equal to about 150° C. (302° F.).

4. The apparatus of claim 1 wherein said adsorbent comprises activated carbon through which substantially all of said gases generated during engine cool down are passed before entry of said gases to said reservoir.

5. The apparatus of claim 4 wherein said gases passed to said reservoir are essentially free of oxygen and wherein entrained oxygen is substantially eliminated from said radiator.

6. The apparatus of claim 1 wherein said excess coolant reservoir, radiator vessel and fluid connection means between said radiator vessel and said internal combustion engine are constructed of an oxygen-impermeable substance.

7. The apparatus of claim 6 wherein said oxygen impermeable substance is selected from impermeable plastic and metal.

8. The apparatus of claim 1 wherein said valve means comprises a vacuum exhaust valve or electrical solenoid to constrict the flow of fluid through said exhaust vent tube.

9. An apparatus for the select exclusion of oxygen from a cooling fluid of an internal combustion engine which comprises:

(a) an indirect cooling fluid radiator closed to ambient air and communicating with said internal combustion engine to indirectly cool said engine when in operation;

(b) a radiator cap to provide closure of said radiator to said ambient air said cap being equipped with an overflow withdrawal means;

(c) an overflow cooling fluid vessel to maintain a supply of excess cooling fluid in addition to the cooling fluid of said radiator and communicating with said radiator by fluid connection means connected to and through said radiator cap;

(d) an exhaust means for expulsion of gases from said overflow cooling fluid vessel generated during start up or continuous operation of said internal combustion engine;

(e) an activated carbon adsorption zone containing activated carbon and communicating with said cooling fluid vessel and said exhaust means to adsorb oxygen from ambient gas passing from said exhaust means to the cooling fluid vessel during cool down of said internal combustion engine;

(f) an engine exhaust means communicating with said engine and said activated carbon zone to provid exhaust gas to contact said adsorbent and to thereby regenerate oxygen adsorption qualities of said activated carbon; and (g) a temperature control means situated intermediate said engine and adsorption zone to provide that the exhaust gas passed from said internal combustion engine to said adsorption zone is at least 140° C. (284° F.) but not in excess of 150° C. (302° F.).

10. The apparatus of claim 9 where said temperature control means comprises a thermostatically controlled valve to insure proper temperature of said exhaust gas being passed to said activated carbon adsorption zone.

11. The apparatus of claim 9 wherein said cooling fluid expands upon heating causing gas to be transferred to said excess cooling fluid vessel and removed from said cooling fluid vessel through said exhaust means and wherein, when said cooling fluid begins cooling after engine shutdown, ambient gas is drawn into said vessel after passage through said activated carbon zone to thereby remove oxygen from said ambient gas by means of said activated carbon adsorption.

12. The apparatus of claim 9 wherein said cooling fluid expands upon heating causing gas to be transferred to said excess cooling fluid vessel and removed from said cooling fluid vessel through said exhaust means.

13. A method of operating an internal combustion engine where said engine communicates with a cooling fluid reservoir that operates segregated from ambient air which comprises:

(a) passing cooling fluid in indirect heat exchange with said internal combustion engine to continuously cool said engine during periods of operation;

(b) passing cooling fluid from said fluid reservoir to an excess cooling reservoir provided with means to vent heated vapors to ambient air wherein said vapors are generated through expansion of cooling fluid during heat up of said cooling fluid during said indirect heat exchange;

(c) cooling said cooling fluid after termination of said heat exchange with said internal combustion engine to cause ambient exhaust gas to be passed into said excess cooling reservoir; and (d) passing said ambient exhaust gas generated by cooling in step (c) through an amount of activated carbon adsorbent for adsorption of oxygen in said gas to thereby reduce the content of entrained oxygen in said generated fluid passed to said excess cooling reservoir and thereby reduce the content of oxygen in said cooling fluid reservoir.

* * * * *